US005954140A

United States Patent [19]

Bauer

[11] Patent Number: 5,954,140

[45] Date of Patent: Sep. 21, 1999

[54] ROTARY HAMMER WITH IMPROVED PNEUMATIC DRIVE SYSTEM

[75] Inventor: David R. Bauer, Delafield, Wis.

[73] Assignee: Milwaukee Electric Tool Corporation, Brookfield, Wis.

[21] Appl. No.: 08/878,053

[22] Filed: Jun. 18, 1997

[51] Int. Cl.[6] ..... B25D 9/04

[52] U.S. Cl. ..... 173/48; 173/109; 173/114; 173/201

[58] Field of Search ..... 173/48, 114, 200, 173/201, 204, 109

[56] References Cited

U.S. PATENT DOCUMENTS

| | | | |
|---|---|---|---|
| 1,800,465 | 4/1931 | Miller et al. | 173/201 |
| 2,638,749 | 5/1953 | Sparano | 173/201 |
| 4,290,492 | 9/1981 | Sides et al. . | |
| 4,325,436 | 4/1982 | Richter et al. . | |
| 4,567,951 | 2/1986 | Fehrle et al. . | |
| 5,111,890 | 5/1992 | Ranger et al. | 173/201 |
| 5,379,848 | 1/1995 | Rauser | 173/109 |
| 5,435,397 | 7/1995 | Demuth | 173/48 |
| 5,456,324 | 10/1995 | Takagi et al. | 173/48 |

FOREIGN PATENT DOCUMENTS

| | | |
|---|---|---|
| 2025830 | 1/1980 | United Kingdom . |
| 2052346 | 1/1981 | United Kingdom . |
| 2313084 | 11/1997 | United Kingdom . |

*Primary Examiner*—Stephen F. Gerrity
*Attorney, Agent, or Firm*—Michael Best & Friedrich LLP

[57] ABSTRACT

A rotary hammer operable in an idle mode and a hammer mode. The rotary hammer includes a housing, a barrel positioned in the housing and including a side wall having a port, a ram positioned within the barrel and axially movable relative to the barrel, and a seal supported on the mid-portion of the ram and forming a seal between the side wall and the ram. The seal has a range of motion relative to the barrel, and the port is located in the side wall such that the port is beyond the range of motion of the seal. The hammer further includes a tool supported by the hammer, and engagement of the tool with a workpiece moves the barrel relative to the housing and changes the hammer from the idle mode to the hammer mode. The hammer further includes a biasing member, such as a spring, biasing the hammer toward the idle mode.

23 Claims, 5 Drawing Sheets

ROTARY HAMMER WITH IMPROVED PNEUMATIC DRIVE SYSTEM

BACKGROUND OF THE INVENTION

The present invention generally relates to rotary hammers and, more particularly, to a pneumatic drive system for a rotary hammer.

In general, rotary hammers operate to impart both rotational, drilling movement and axial, hammering movement on a tool bit. In this regard, rotary hammers include both a rotary drive system and an axial drive system. A typical rotary drive system includes a gear and pinion assembly which imparts rotational movement on a spindle and on the bit. One type of axial drive system is a ratchet-type drive system which drives the bit through engagement of complementary ratchet surfaces. Another axial drive system includes a pneumatic drive system which uses an axially reciprocating piston to drive the bit.

A prior art pneumatic rotary hammer 200 is partially shown in FIGS. 5, 6, and 6A. The hammer 200 includes a rotary drive system 204 (partially shown) which drives a tool bit 208 for rotational drilling movement about an axis 212, and a pneumatic drive system 216 which is operable to impart axial, hammering movement on the tool bit 208. The pneumatic drive system 216 is selectively engageable and includes a cylindrical barrel 220, a reciprocating piston 224, a ram 228, and a striker 232. The piston 224 reciprocates within the hollow portion of the barrel 220 to form a piston and cylinder assembly. A seal 236 is supported on the piston 224 and forms a seal between the piston 224 and the barrel 220. The ram 228 is supported within the barrel 220 for axial movement relative to the barrel 220. A seal 240 is supported on the ram 228 to form a seal between the ram 228 and the barrel 220. The ram 228 is engageable with the rearward end of the striker 232 to cause hammering. The forward end of the striker 232 engages the bit 208.

Idle ports 244 are formed circumferentially in the sidewall of the barrel 220. When the idle ports 244 are open to the atmosphere (FIG. 5), air flows into and out of the space between the piston 224 and the ram 228 through the idle ports 244. When the idle ports 244 are closed (FIGS. 6 and 6A), air cannot flow into and out of the space between the piston 224 and the ram 228. When the piston 224 reciprocates with the idle port 244 closed, a vacuum is formed in this space. A forward port 248 is also formed in the sidewall of the barrel 220. Air flows into and out of the space between the ram 228 and the striker 232 through the forward port 248.

The hammer 200 has an idle mode (FIG. 5) and a hammer mode (FIGS. 6 and 6A). In the idle mode, although the piston 224 reciprocates, the pneumatic drive system 216 does not operate to impart axial, hammering movement on the bit 208. More specifically, the idle mode of the hammer 200 corresponds with the ram 228 being in the forward position (FIG. 5). In this position, the idle ports 244 are open so that air moves into and out of the space between the piston 224 and the ram 228 as the piston 224 reciprocates.

To engage the hammer mode, the operator pushes the bit 208 against the workpiece forcing the striker 232 to move rearward. The striker 232 pushes the ram 228 rearward so that the seal 240 on the ram 228 crosses and closes the idle ports 244 (see FIGS. 6 and 6A). This seal allows a vacuum to be formed in the space between the piston 224 and the ram 228. As the piston 224 moves rearwardly, the ram 228 will follow due to the vacuum (FIG. 6). On the forward stroke of the piston 224, the ram 228 is forced forward and slams into the striker 232 (FIG. 6A). The striker 232, in turn, slams into the bit 208 causing a hammering motion. This hammering cycle continues as the piston 224 reciprocates and as long as the idle port 244 is closed.

When the bit 208 is withdrawn from the workpiece, the ram 228 will move back to the forward position so that the idle ports 244 are uncovered (FIG. 5). When this occurs, the seal 240 on the ram 228 again crosses the idle ports 244. In the typical prior art rotary hammer 200, the operator disengages the hammering after only relatively few (e.g. about ten) hammering cycles. The hammer mode must be re-engaged by again moving the ram 228 and the seal 240 over the idle ports 244.

The movement of the seal 240 across the idle port 244 causes the seal 240 to wear. If the seal 240 fails, a vacuum will not be formed in the space between the piston 224 and the ram 228, and the pneumatic drive system 216 will not operate as effectively. The seal 240 must be replaced for the hammer 200 to operate at its full capacity. If the seal 240 fails on the rearward stroke of the piston 224, the ram 228 can slam into the piston 224, causing severe damage to the piston 224. In this case, the complete pneumatic drive system 216 may need to be replaced. To prevent the seal 240 from wearing out and failing, another part, such as a conductive brush (not shown), is commonly designed to wear out before the seal 240. Once the conductive brush wears out, the electric motor will not operate. At this point, the user normally returns the hammer to the manufacturer for a complete overhaul at which time the seal 240 is also replaced.

SUMMARY OF THE INVENTION

The rotary hammer described above has several problems. For example, because a part, such as a conductive brush, is designed to wear out and force a complete overhaul of the rotary hammer before the seal fails, the useful life of this part and of the rotary hammer is not maximized. Additionally, if the seal does wear out and fail, the ram can severely damage the piston which may require a complete replacement of the pneumatic drive system. In both cases, the cost of operating the rotary hammer is increased.

The present invention provides a rotary hammer with an improved pneumatic drive system that attempts to alleviate the problems relating to existing rotary hammers. In one aspect, the invention provides a rotary hammer that is operable in an idle mode and a hammer mode. The rotary hammer comprises a housing, a barrel positioned in the housing and including a sidewall having a port, a ram positioned within the barrel and movable relative to the barrel, and a seal supported on the ram and forming a seal between the sidewall and the ram. The port is located on the sidewall beyond the range of motion of the seal. In one embodiment, the range of motion of the seal is within a forward portion of the barrel, between the port and the forward end of the barrel, and the seal is supported on the mid-portion of the ram.

In another aspect, the invention provides a rotary hammer comprising a housing and a barrel supported within the housing. The barrel is movable (e.g., axially) relative to the housing to change the hammer between idle and hammer modes. The barrel includes a sidewall having a port. In one embodiment, the port is open to the atmosphere when the hammer is in the idle mode and closed from the atmosphere when the hammer is in the hammer mode. Preferably, the hammer further comprises a support member having an opening. The port is substantially aligned with the opening when the hammer is in the idle mode and substantially misaligned with the opening when the hammer is in the hammer mode.

In yet another aspect, the invention provides a rotary hammer comprising a housing, a barrel supported in the housing and including a sidewall having a port, and a biasing member. The hammer is selectively adjustable between a port open position and a port closed position, and the biasing member biases the hammer towards the port open position. In one embodiment, the barrel is movable relative to the housing, and the biasing member is a spring positioned between the barrel and the housing. Engagement of the tool with the workpiece overcomes the force of the biasing member so that the hammer is adjusted toward the port closed position.

In another aspect, the invention provides a rotary hammer comprising a housing, a barrel positioned in the housing and including a sidewall having a port, a ram supported within the barrel and axially movable relative to the barrel, and a seal supported on the ram and forming a seal between the ram and the sidewall. The seal is positioned (e.g., centered) on the mid-portion of the ram. In one embodiment, the mid-portion of the ram does not cross the port.

One advantage of the present invention is that the seal supported on the ram does not need to cross the port in the sidewall of the barrel. This reduces the wear of the seal. The rotary hammer does not need to be designed to require a complete overhaul before the seal wears out, thus extending the useful life of the rotary hammer. Similarly, the potential for the piston being damaged is greatly reduced.

Other features of the invention will become apparent to those skilled in the art upon review of the following detailed description, claims and drawings.

DETAILED DESCRIPTION OF THE PREFERRED EMBODIMENT

Figures 1, 2:
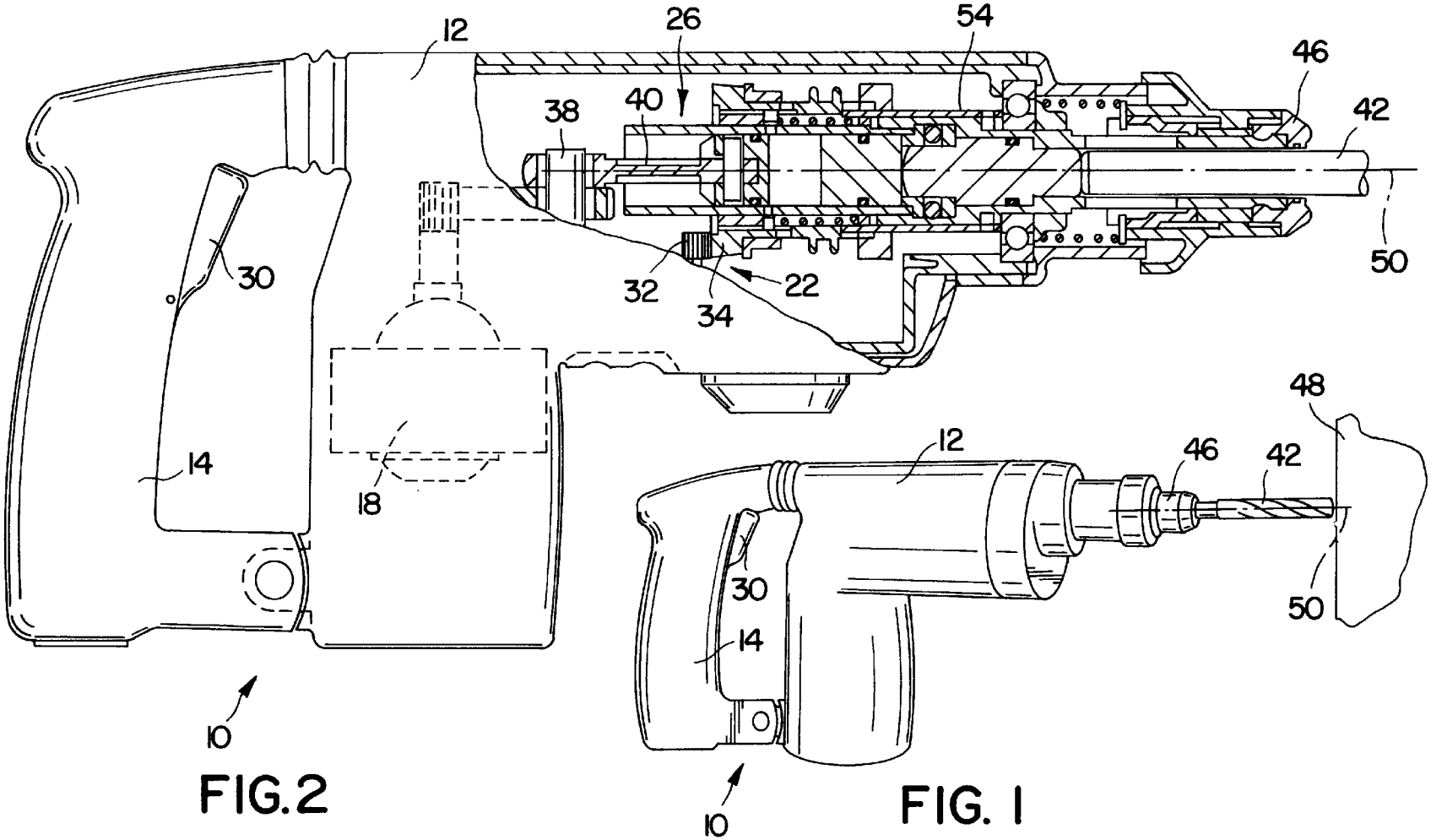
FIG. 1 is a perspective view of a rotary hammer embodying the invention.
FIG. 2 is a partial cross-sectional view of the rotary hammer of FIG. 1.

FIGS. 1 and 2 illustrate a rotary hammer 10 embodying the present invention. The rotary hammer 10 comprises a housing 12, an operator's grip or handle 14, an electric motor 18, a rotary drive system 22, and a pneumatic drive system 26.

The electric motor 18 is conventionally connected to an electric power source, and a conventional switch 30 located near the handle 14 is used to selectively activate the motor 18. The motor 18 drives a pinion 32 that engages a gear 34 of the rotary drive system 22. The motor 18 further drives a crankshaft 38 that provides reciprocating motion to a connecting rod 40 of the pneumatic drive system 26.

The rotary hammer 10 further comprises a tool or bit 42 that is supported in a tool holder or chuck 46. The bit 42 has (see FIG. 1) an end for engaging a workpiece 48 and (see FIG. 2) a rearward end. The bit 42 defines an axis 50 of the rotary hammer 10. As explained below, the rotary hammer 10 selectively drives the bit 42 for both rotary drilling motion about the axis 50 and reciprocating or hammering motion along the axis 50. Also as explained below, the rotary hammer 10 has an idle mode (shown in FIG. 3) and a hammer mode (shown in FIGS. 4 and 4A).

For purposes of description, "forward" is defined as being in the direction of the workpiece engaging end of the bit 42 along the axis 50. Similarly, "rearward" is defined relative to "forward" as being in the direction of the handle 14 and away from the workpiece engaging end of the bit 42 along the axis 50.

Figure 7:
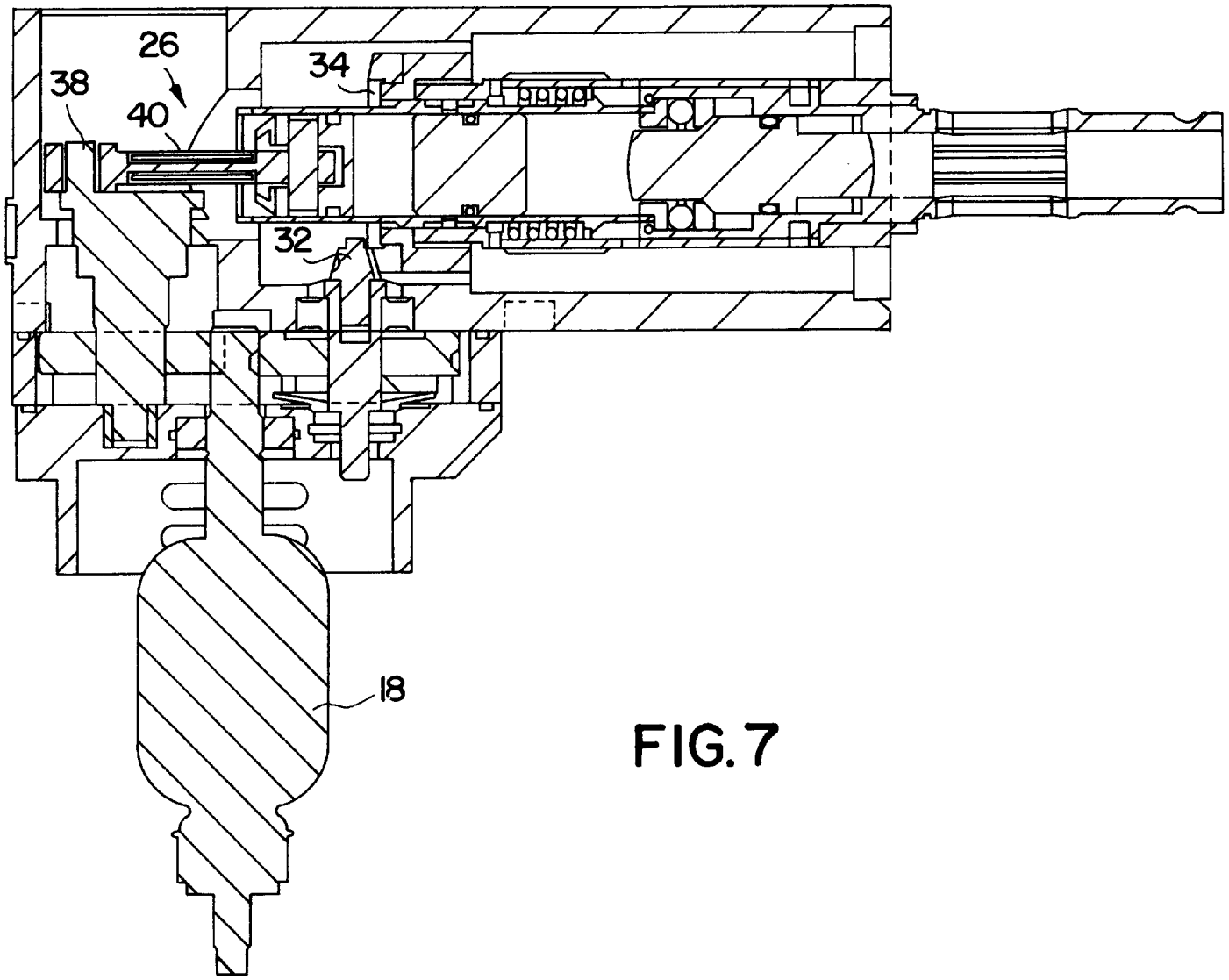
FIG. 7 illustrates an alternative drive system arrangement.

As shown in FIG. 2, the rotary drive system 22 includes a cylindrical spindle 54 rotatably mounted within the housing 12. The spindle 54 is driven by the pinion 32 and the gear 34. The rotary drive system 22 is generally conventional and, therefore, need not be described in great detail. Any conventional drive mechanism, such as the pinion 32 and gear 34 assembly, can be used to drive the spindle 54 for rotational movement about the axis 50. The rotation of the spindle 54 causes the bit 42 to rotate for rotational, drilling movement. FIG. 7 illustrates an alternative arrangement of the motor and drive systems.

The cylindrical spindle 54 (see FIGS. 3, 4, and 4A) is hollow and forms a support member for the pneumatic drive system 26. The axis of the spindle 54 is aligned with the axis 50 of the rotary hammer 10. An annular ridge 58 is formed on the inner surface of the spindle 54. At least one opening 62 is formed in the sidewall of the spindle 54. In the illustrated embodiment, two openings 62 are formed in the sidewall of the spindle 54 on opposite sides of the axis 50. Each opening 62 is open to the atmosphere surrounding the rotary hammer 10. An annular groove 64 is formed in the inner surface of the spindle 54. The groove 64 opens into the openings 62. An annular land portion 66 is formed in the spindle 54 adjacent to the groove 64 and adjacent to each opening 62. The purposes for the ridge 58, the openings 62, the groove 64, and the land portion 66 are explained below.

The pneumatic drive system 26 includes a cylindrical barrel 70. The barrel 70 is hollow and has an axis that is aligned with the hammer axis 50. The barrel 70 is supported in the hollow spindle 54 and is movable relative to the spindle 54 along the axis 50. The barrel 70 also has at least one idle port 74 formed in the sidewall of the barrel 70. In the illustrated embodiment, two idle ports 74 are formed in the sidewall of the barrel 70 on opposite sides of the axis 50. A forward portion of the barrel 70 is defined between the idle ports 74 and the forward end of the barrel 70. Similarly, a rearward portion of the barrel 70 is defined between the idle ports 74 and the rearward end of the barrel 70. The barrel 70 also includes at least one forward port 78, and preferably two, formed in the sidewall of the barrel 70 adjacent the forward end. A protrusion or annular ridge 82 is formed on the outer surface of the barrel 70. The purposes for the idle ports 74, the forward ports 78, and the ridge 82 are explained below.

The pneumatic drive system 26 also includes a reciprocating piston 86 that is connected to and driven by the connecting rod 40. The reciprocating piston 86 is supported in the barrel 70 for axial movement relative to the barrel 70. The barrel 70 and the piston 86 form a piston and cylinder assembly. The piston 86 includes a piston seal 94 that forms a seal between the piston 86 and the sidewall of the barrel 70. The seal 94 has a range of motion that is within the rearward portion of the barrel 70 so that the seal 94 does not cross the idle ports 74.

The pneumatic drive system 26 also includes a ram 98 supported in the barrel 70 for axial movement relative to the barrel 70 along the axis 50. The ram 98 has a forward end, a rearward end, and a center 102 between the ends. The ram 98 also has a mid-portion that is defined as the inner half of the ram 98 between its ends. The ram 98 also includes a ram seal 106 supported on the ram 98 and forming a seal between the ram 98 and the sidewall of the barrel 70. As discussed in more detail below, the seal 106 has a range of motion that is within the forward portion of the barrel 70 so that the seal 106 does not cross the idle ports 74. The seal 106 also does not cross the forward ports 78. Preferably, the seal 106 is supported on the mid-portion of the ram 98, and, most preferably, the seal 106 is supported on the center 102 of the ram 98.

The pneumatic drive system 26 also includes a striker 110. The striker 110 has an end which normally engages the bit 42. The striker 110 also includes an opposite end which is engageable with the ram 98, as explained below. A portion of the striker 110 extends into the forward portion of the barrel 70. The striker 110 also includes a pair of spaced apart, oppositely facing engagement portions 114 and 118.

The striker 110 is supported by a cylindrical support element 122, which forms part of the spindle 54. The striker 110 is movable relative to the support element 122 between a forward position and a rearward position. The support element 122 includes a shoulder portion 126 which engages the forward engagement portion 114 of the striker 110 when the striker 110 is in the forward position. The support element 122 also includes a second shoulder portion 130. The support element 122 also supports the rearward end of the bit 42.

A cushion washer combination 134 is supported in the support member 122 for axial movement relative to the support member 122. In the forward position, the cushion washer combination 134 engages the second shoulder portion 130 (see FIG. 3). The cushion washer combination 134 also engages the forward end of the barrel 70. The rearward engagement portion 118 of the striker 110 engages the cushion washer combination 134.

Figure 3:
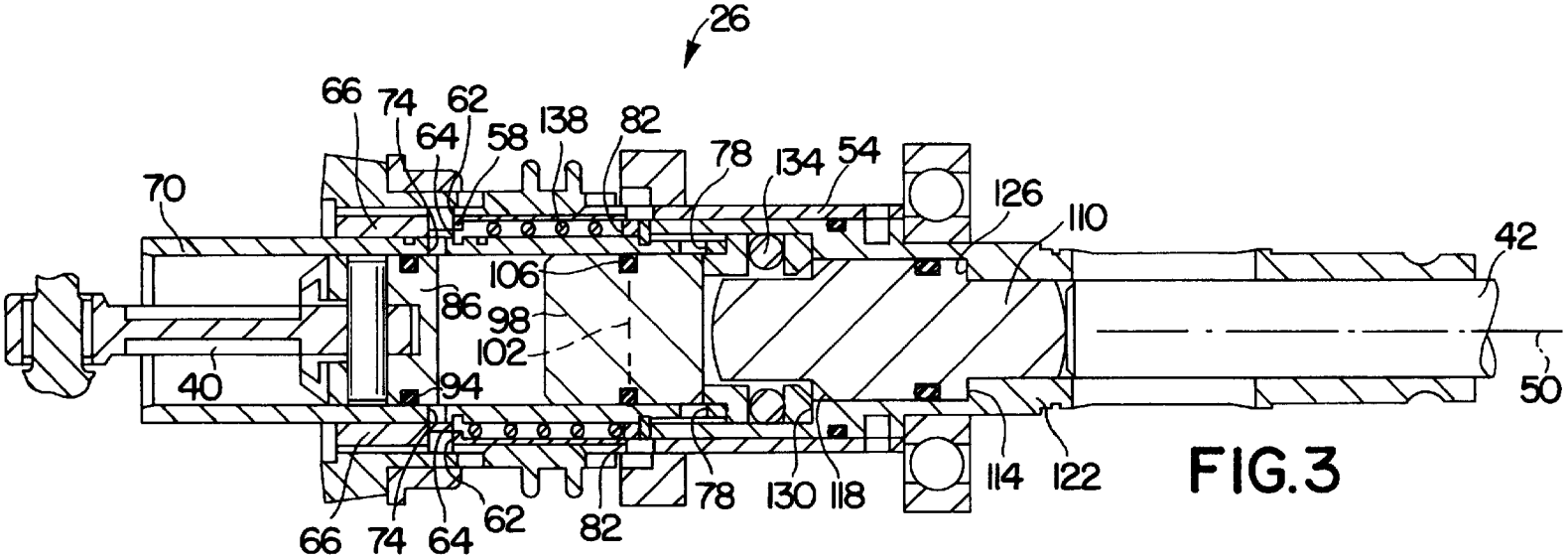
FIG. 3 is a cross-sectional view of the pneumatic drive system of the hammer shown in FIG. 2 when the hammer is in the idle mode.
Figure 4:
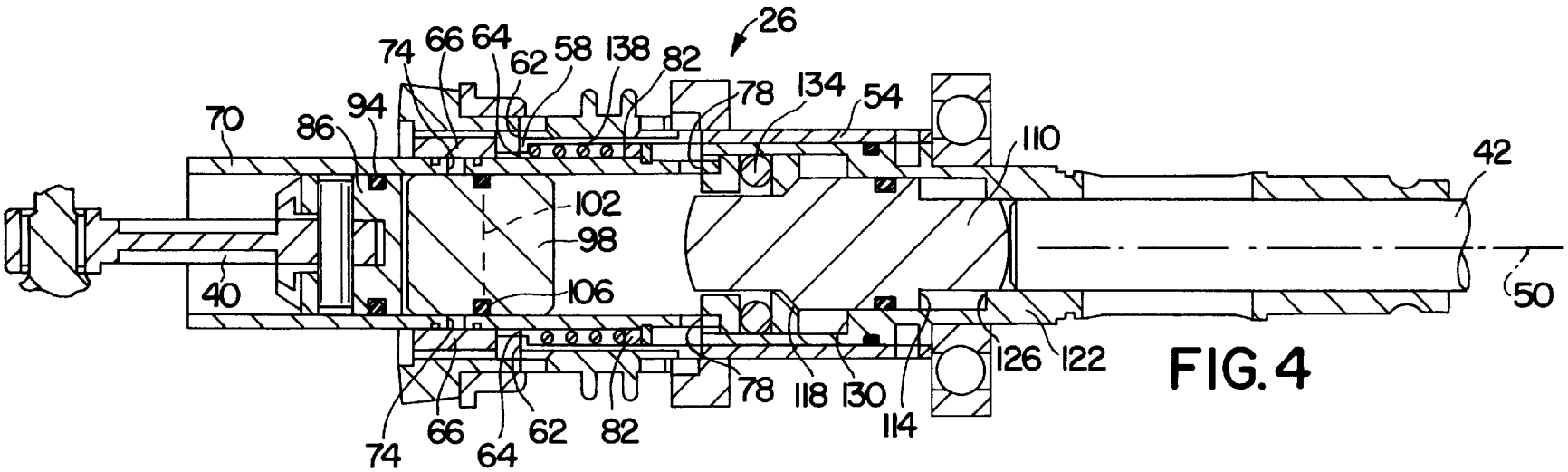
FIG. 4 is a view similar to that in FIG. 3 and shows the pneumatic drive system when the hammer is in the hammer mode and the piston is retracted.

As shown in the change of position from FIG. 3 to FIG. 4, when the bit 42 engages the workpiece 48, the rearward end of the bit 42 engages the striker 110, pushing the striker 110 rearward. The second engagement portion 118 of the striker 110 engages the cushion washer combination 134 which, in turn, engages the barrel 70 and moves the barrel 70 rearward.

The pneumatic drive system 26 also includes a biasing mechanism. In the preferred embodiment, the biasing mechanism includes a spring 138 positioned between the spindle 54 and the barrel 70. In the illustrated construction, the spring 138 is a coil spring which surrounds the outer surface of the barrel 70. One end of the spring 138 engages the ridge 82 formed on the outer surface of the barrel 70, and the other end of the spring 138 engages the ridge 58 formed on the inner surface of the spindle 54. The spring 138 biases the barrel 70 toward the forward position. The rearward motion of the striker 110, as described above, can overcome the biasing force of the spring 138 to move the barrel 70 rearward relative to the spindle 54, to the rearward position of the barrel 70.

In operation, the rotary hammer 10 is connected to an electrical power source, and the operator engages the switch 30. The motor 18 drives both the rotary drive system 22 and the pneumatic drive system 26. The rotary drive system 22 drives the spindle 54 in a rotary motion in the selected direction. The reciprocating piston 86 is driven by the motor 18, though this will not cause hammering movement of the bit 42 unless the rotary hammer 10 is placed in the hammer mode.

As explained above, the rotary hammer 10 is biased toward the idle mode. In the idle mode, the rotary hammer 10 does not impart the axial, reciprocating hammer motion on the bit 42. As shown in FIG. 3, in the idle mode, the idle ports 74 are in the port open position with the idle ports 74 being open to the atmosphere surrounding the rotary hammer 10. At least a portion of each idle port 74 is substantially aligned with the corresponding opening 62 or the groove 64 formed in the spindle 54. In this mode, as the piston 86 reciprocates, air moves into and out of the space between the piston 86 and the ram 98. A vacuum is not created in this space, and, therefore, the ram 98 is not caused to move.

Figure 4A:
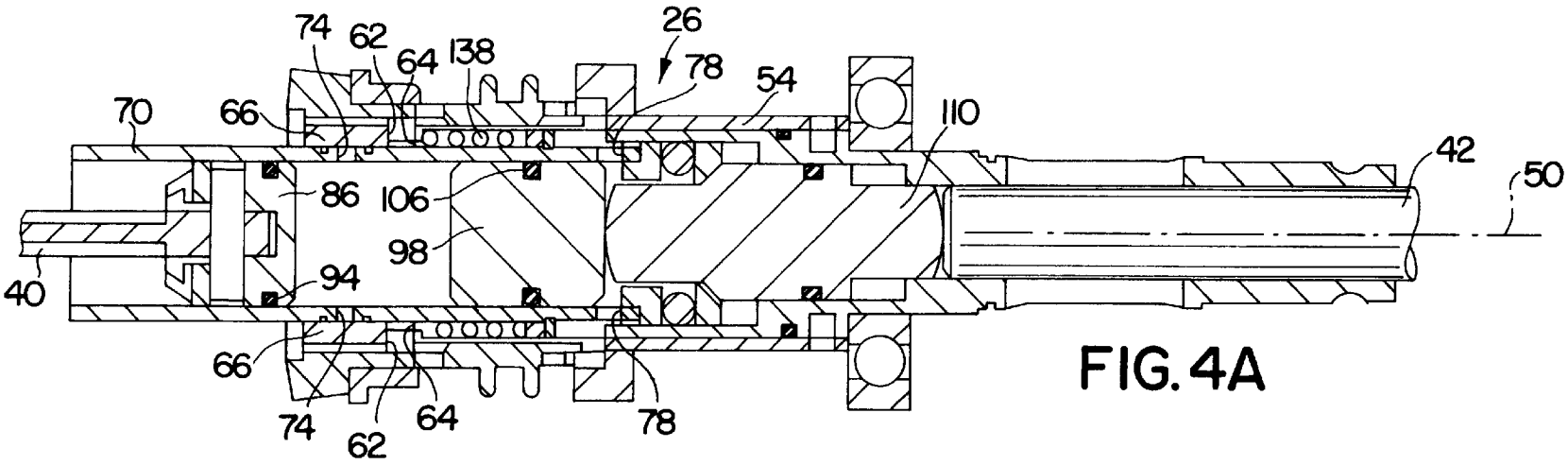
FIG. 4A is a view similar to that in FIG. 4 and shows the piston extended.
Figure 5:
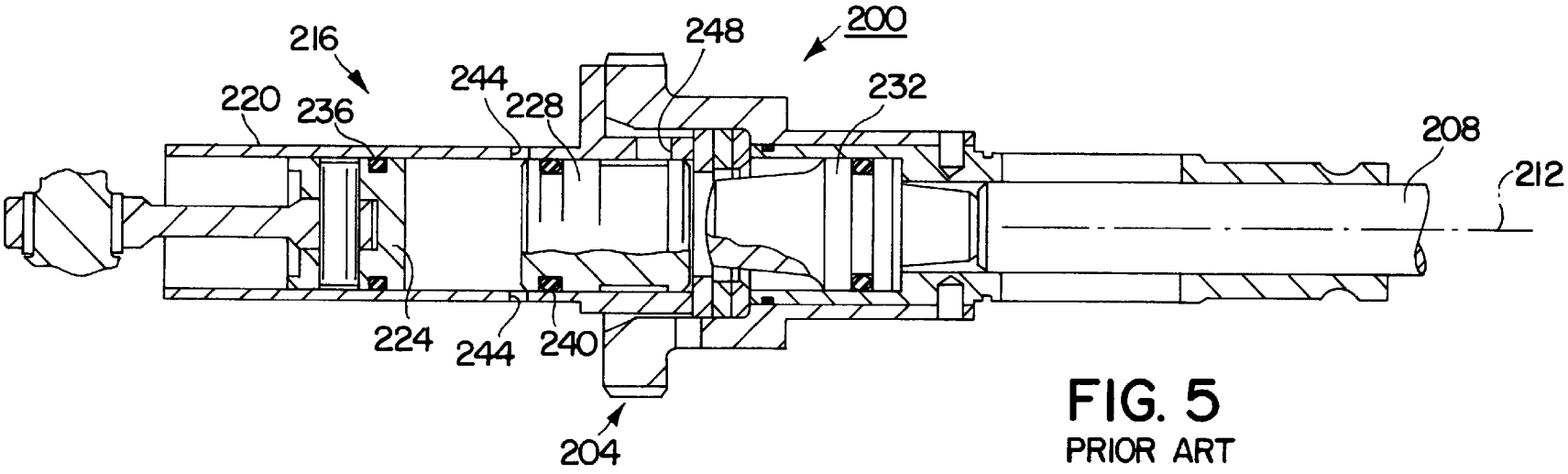
FIG. 5 PRIOR ART
FIG. 5 is an expanded cross-sectional view of the pneumatic drive system of a prior art rotary hammer when the hammer is in the idle mode.
Figure 6:
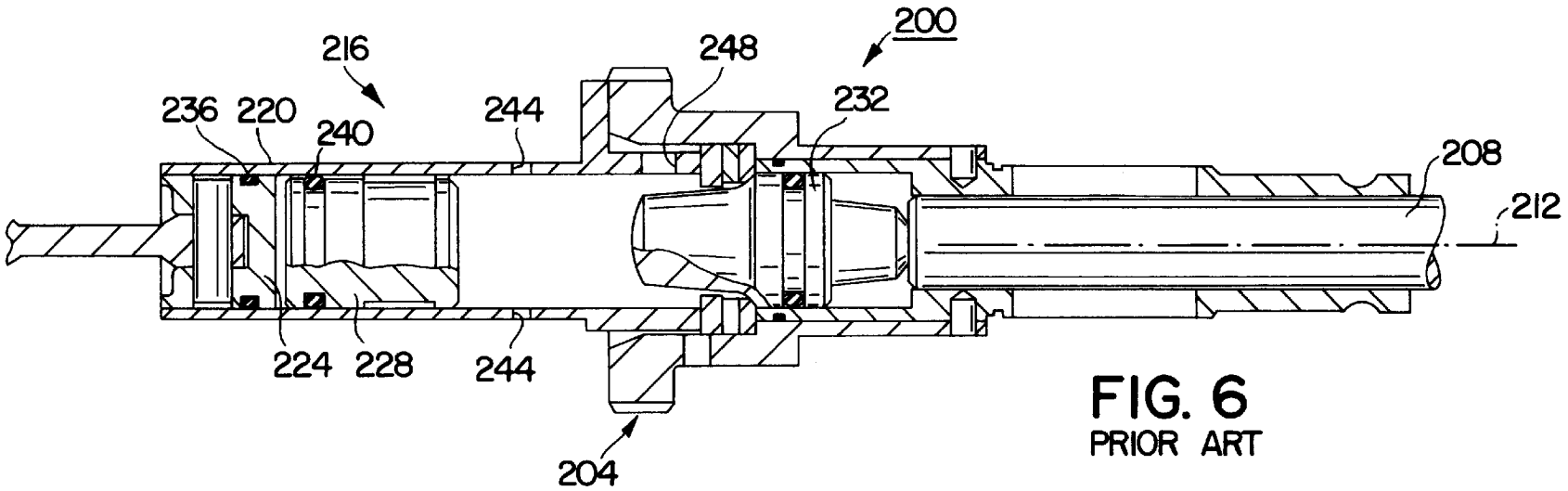
FIG. 6 PRIOR ART
FIG. 6 is a view similar to that in FIG. 5 and shows the prior art pneumatic drive system when the rotary hammer is in the hammer mode and the piston is retracted.
Figure 6A:
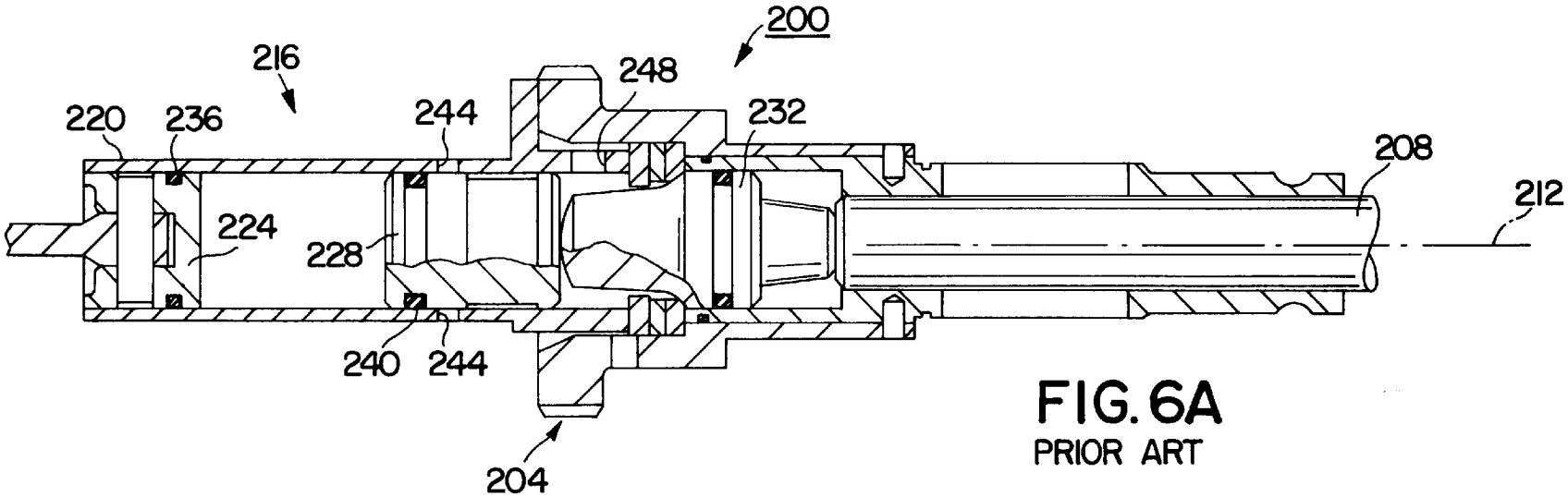
FIG. 6A PRIOR ART
FIG. 6A is a view similar to that in FIG. 6 and shows the piston extended.

To change the rotary hammer 10 from the idle mode to the hammer mode, the operator engages the bit 42 against the workpiece 48 (FIG. 1). As explained above and as shown in FIG. 4, the rearward end of the bit 42 engages the striker 110 and causes the striker 110 to move in a rearward direction. The striker 110 engages the cushion washer combination 134, forcing the barrel 70 to also move in a rearward direction. As the barrel 70 moves rearward with respect to the spindle 54, the idle ports 74 become misaligned with the openings 62 and the groove 64. The idle ports 74 move into alignment with the land portion 66 adjacent to the openings 62 and adjacent to the groove 64. The barrel 70 and the land portion 66 form a shear seal closing the idle ports 74 from the atmosphere surrounding the rotary hammer 10. The idle ports 74 are in the port closed position and the rotary hammer 10 is in the hammer mode (FIGS. 4 and 4A).

In another embodiment, the idle ports 74 may be closed from the atmosphere by rotational movement of the spindle 54 relative to the barrel 70. In yet another embodiment, the idle ports 74 may be closed by a mechanism, such as a movable sleeve (not shown), which selectively covers the openings 62 in the spindle 54 or the idle ports 74.

With the idle ports 74 closed, a vacuum is created in the space between the piston 86 and the ram 98. As the piston 86 moves rearward, the ram 98 is also drawn rearward by the force of the vacuum. Air moves through the forward ports 78 into the space between the ram 98 and the striker 110 so that a vacuum is not also created on this side of the ram 98. The ram 98 continues backwards and compresses the air in the space between the piston 86 and the ram 98. As the piston 86 begins its forward stroke, the air between the piston 86 and the ram 98 reaches its maximum compression (FIG. 4). The ram 98 is forced forward by the forward movement of the piston 86 and the expansion of the air in the space between the piston 86 and the ram 98. As the ram 98 moves forward, air moves through the forward ports 78 out of the space between the ram 98 and the striker 110 so that the forward movement of the ram 98 is not substantially impeded. As shown in FIG. 4A, the ram 98 slams into the striker 110, and the striker 110 slams into the bit 42. This is one hammer cycle. The rotary hammer 10 continues to operate in the hammer mode as the piston 86 reciprocates as long as the idle ports 74 are in the port closed position.

To disengage the hammer mode, the operator disengages the bit 42 from the workpiece 48. The spring 138 applies the biasing force to the spindle 54 and the barrel 70 and forces the barrel 70 to move in a forward direction relative to the spindle 54. The barrel 70 moves forward until the cushion washer combination engages the second shoulder portion 130 of the support member 122. The striker 110 also moves forward until the forward engagement portion 114 of the striker 110 engages the first shoulder portion 126 of the support member 122. The idle ports 74 are again aligned with the openings 62 or the groove 64 in the port open position, and the rotary hammer 10 is again in the idle mode (FIG. 3).

As shown in FIGS. 3, 4 and 4A, the ram seal 106 does not cross the idle ports 74 or the forward ports 78. Similarly, the piston seal 94 does not cross the idle ports 74. The amount of wear on the seals 94 and 106 is thus reduced, and the useful life of the rotary hammer 10 is increased.

The foregoing description of the present invention has been presented for purposes of illustration and description. Furthermore, the description is not intended to limit the invention to the form disclosed herein. Consequently, variations and modifications commensurate with the above teachings, and the skill or knowledge of the relative art, are within the scope of the present invention. The embodiments described herein are further intended to explain best modes known for practicing the invention and to enable others skilled in the art to utilize the invention in such, or other, embodiments and with various modifications required by the particular applications or uses of the present invention. It is intended that the appended claims be construed to include alternative embodiments to the extent permitted by the prior art.

What is claimed is:

1. A rotary hammer operable in an idle mode and a hammer mode, said rotary hammer comprising:

a housing;

a barrel positioned in said housing and including a side wall having a port, said port being open to permit gas flow through said port when said rotary hammer is in the idle mode, said port being closed to gas flow when said rotary hammer is in the hammer mode;

a ram positioned within said barrel and movable relative to said barrel; and a seal supported on said ram and forming a seal between said side wall and said ram, said seal being movable with said ram through a range of motion relative to said barrel during operation of said rotary hammer, wherein said port is located in said side wall such that said port is beyond the range of motion of said seal.

2. The rotary hammer as set forth in claim 1, wherein said barrel has a forward end and a forward portion defined between said port and said forward end, and wherein said range of motion of said seal is within said forward portion of said barrel.

3. The rotary hammer as set forth in claim 1, wherein said barrel is movable relative to said housing to change the mode of operation of said rotary hammer between the idle mode and the hammer mode.

4. The rotary hammer as set forth in claim 3, wherein said housing has an axis, and wherein said barrel is axially movable relative to said housing.

5. The rotary hammer as set forth in claim 3, further comprising a tool supported by said rotary hammer, and wherein engagement of said tool with a workpiece moves said barrel and changes said rotary hammer from the idle mode to the hammer mode.

6. The rotary hammer as set forth in claim 1, wherein said rotary hammer is biased toward the idle mode, and wherein a biasing force must be overcome to change the mode of operation of said rotary hammer from the idle mode to the hammer mode.

7. The rotary hammer as set forth in claim 6, wherein said barrel is movable relative to said housing to change the mode of operation of said rotary hammer between the idle mode and the hammer mode, and wherein said rotary hammer further comprises a biasing member positioned between said barrel and said housing such that said rotary hammer is biased toward the idle mode.

8. The rotary hammer as set forth in claim 7, further comprising a tool supported by said rotary hammer, and wherein engagement of said tool with a workpiece overcomes the biasing of said biasing member so that said rotary hammer is adjusted toward the hammer mode.

9. The rotary hammer as set forth in claim 1, wherein said ram has a mid-portion, and wherein said seal is positioned on said mid-portion of said ram.

10. The rotary hammer as set forth in claim 1, further comprising a support member including a side wall having an opening, wherein said barrel is supported within said support member and is movable relative to said support member, wherein at least a portion of said port is substantially aligned with said opening when said hammer is in the idle mode, and wherein said port is substantially misaligned with said opening when said hammer is in the hammer mode.

11. A rotary hammer operable in an idle mode and a hammer mode, said rotary hammer comprising:

a housing;

a barrel positioned in said housing and including a side wall having a port, said port being open to the atmosphere when said rotary hammer is in the idle mode, said port being closed from the atmosphere when said rotary hammer is in the hammer mode;

a ram supported within said barrel and axially movable relative to said barrel, said ram having a mid-portion, wherein said mid-portion of said ram does not cross said port; and a seal supported on said ram and forming a seal between said ram and said side wall, said seal being positioned on said mid-portion of said ram.

12. The rotary hammer as set forth in claim 11, wherein said ram has spaced ends, and wherein said seal is centered between said ends.

13. A rotary hammer operable in an idle mode and a hammer mode, said rotary hammer comprising:

a housing;

a barrel supported within said housing, said barrel being movable relative to said housing to change the mode of operation of said rotary hammer between the idle mode and the hammer mode, said barrel including a side wall having a port, said port being open to the atmosphere when said rotary hammer is in the idle mode, and said port being closed from the atmosphere when said rotary hammer is in the hammer mode; and a support member including a side wall having an opening, wherein said barrel is supported within said support member and is movable relative to said support member, wherein at least a portion of said port is substantially aligned with said opening when said rotary hammer is in the idle mode, and wherein said port is substantially misaligned with said opening when said rotary hammer is in the hammer mode.

14. The rotary hammer as set forth in claim 13, wherein said housing has an axis, and wherein said barrel is axially movable relative to said housing.

15. The rotary hammer as set forth in claim 14, further comprising a tool supported by said rotary hammer, wherein said axis of said housing is aligned with an axis of said tool, and wherein engagement of said tool with a workpiece causes axial movement of said barrel to change the mode of operation of said rotary hammer from the idle mode to the hammer mode.

16. The rotary hammer as set forth in claim 13, wherein said housing has an axis, and wherein said barrel is axially movable relative to said housing.

17. The rotary hammer as set forth in claim 16, further comprising a tool supported by said hammer, wherein said axis of said housing is aligned with an axis of said tool, and wherein engagement of said tool with a workpiece causes axial movement of said barrel to change said hammer from the idle mode to the hammer mode.

18. A rotary hammer operable in an idle mode and a hammer mode, said rotary hammer comprising:

a housing;

a barrel positioned in said housing and including a side wall defining at least one port;

a ram positioned within said barrel and movable relative to said barrel; and a seal supported on said ram and forming a seal between said side wall and said ram, said seal being movable with said ram relative to said barrel, wherein, during movement of said seal, said seal does not cross any port defined in said side wall.

19. The rotary hammer as set forth in claim 18 wherein said at least one port is an idle port, said idle port being open to permit gas flow through said at least one port when said rotary hammer is in the idle mode, and said idle port being closed to gas flow when said rotary hammer is in the hammer mode.

20. The rotary hammer as set forth in claim 19 wherein said barrel is movable relative to said housing to change the mode of operation of said rotary hammer between the idle mode and the hammer mode.

21. The rotary hammer as set forth in claim 20 wherein said housing has an axis, and wherein said barrel is axially movable relative to said housing.

22. The rotary hammer as set forth in claim 20 further comprising a biasing member positioned between said barrel and said housing such that said rotary hammer is biased toward the idle mode.

23. The rotary hammer as set forth in claim 22 further comprising a tool supported by said rotary hammer, and wherein engagement of said tool with a workpiece overcomes the biasing of said biasing member so that said rotary hammer is adjusted to the hammer mode.

* * * * *